US009943161B2

(12) United States Patent
Sawhney et al.

(10) Patent No.: US 9,943,161 B2
(45) Date of Patent: Apr. 17, 2018

(54) STRAP PAD

(71) Applicant: RKS Ventures LLC, Thousand Oaks, CA (US)

(72) Inventors: Ravi Sawhney, Thousand Oaks, CA (US); John Michael Elam, Woodland Hills, CA (US); Zeke Johson, Thousand Oaks, CA (US); Michael Herring, Thousand Oaks, CA (US)

(73) Assignee: RKS VENTURES LLC, Thousand Oaks, CA (US)

( * ) Notice: Subject to any disclaimer, the term of this patent is extended or adjusted under 35 U.S.C. 154(b) by 0 days.

(21) Appl. No.: 15/404,508

(22) Filed: Jan. 12, 2017

(65) Prior Publication Data

US 2017/0196347 A1 Jul. 13, 2017

Related U.S. Application Data

(60) Provisional application No. 62/277,565, filed on Jan. 12, 2016.

(51) Int. Cl.

| | |
|---|---|
| ***A45F 3/12*** | (2006.01) |
| ***A63B 55/00*** | (2015.01) |
| ***G10G 5/00*** | (2006.01) |

(52) U.S. Cl.

CPC ..... *A45F 3/12* (2013.01); *A63B 55/408* (2015.10); *G10G 5/005* (2013.01)

(58) Field of Classification Search

CPC ..... A45F 3/12; A45F 3/02; A45F 3/04; A45F 2003/122; A45C 13/30; A63B 55/408; G10G 5/005

See application file for complete search history.

(56) References Cited

U.S. PATENT DOCUMENTS

| | | | | | |
|---|---|---|---|---|---|
| 414,916 | A * | 11/1889 | Nelson | A45F 3/12 | 224/264 |
| D302,607 | S * | 8/1989 | Krebs | D29/122 | |
| 5,566,871 | A * | 10/1996 | Weintraub | A45F 3/12 | 2/268 |
| 6,318,609 | B1 * | 11/2001 | Swierz | A45F 3/12 | 2/460 |
| 6,467,661 | B1 * | 10/2002 | Mistretta | A45F 3/12 | 2/268 |
| 6,481,022 | B1 * | 11/2002 | D'Addario | A45F 3/12 | 2/268 |
| 2004/0185247 | A1 * | 9/2004 | Fenton | A45F 3/12 | 428/327 |
| 2004/0221373 | A1 * | 11/2004 | Lee | A45C 13/30 | 2/268 |
| 2005/0115108 | A1 | 6/2005 | Palchetti | | |
| 2007/0007314 | A1 * | 1/2007 | Lin | A45F 3/12 | 224/264 |

(Continued)

*Primary Examiner* — Corey Skurdal
(74) *Attorney, Agent, or Firm* — Risso I.P.

(57) ABSTRACT

Described is a strap pad for a shoulder strap. The strap pad includes a shoulder strap connector that is formed to wrap around and connect with the shoulder strap. Notably, a plurality of studs are affixed to and project from the shoulder strap connector. The studs are positioned to disperse the pressure and weight of the accompanying item across the muscles more evenly when the shoulder strap is positioned around the neck or shoulders of a user.

18 Claims, 10 Drawing Sheets

(56) References Cited

U.S. PATENT DOCUMENTS

| | | | | |
|---|---|---|---|---|
| 2008/0142557 | A1* | 6/2008 | Hess | A45C 3/02<br>224/264 |
| 2012/0052249 | A1* | 3/2012 | Turner | A41D 13/0156<br>428/172 |
| 2014/0205787 | A1* | 7/2014 | Ou | B32B 3/04<br>428/71 |

* cited by examiner

Example Stud Sizing:

STRAP PAD

CROSS-REFERENCE TO RELATED APPLICATIONS

This is a non-provisional application of U.S. Provisional Application No. 62/277,565, filed on Jan. 12, 2016.

BACKGROUND OF THE INVENTION (1) Field of Invention

The present invention relates to shoulder straps and, more particularly, to a strap pad for a shoulder strap having studs that are shaped and positioned to provide pressure to pressure points located within the muscle when the shoulder strap is positioned around the neck or shoulders of a user.

(2) Description of Related Art

Straps, such as shoulder straps, have long been known in the art and are used to carry a variety of objects, from purses to musical instruments, such as guitars. For example, guitar straps are typically slung over a musician's shoulder and are used to hold the guitar against and in front of the musician. While operable, such shoulder straps do little to ease the discomfort of wearing a heavy item slung over the musician's shoulders.

Thus, a continuing need exists for a shoulder strap or strap pad that massages a user by directing pressure to pressure points within the user's muscles.

SUMMARY OF INVENTION

The present invention is directed to a shoulder strap or strap pad that massages a user by directing pressure to pressure points within the user's muscles. The strap pad includes a shoulder strap connector. The shoulder strap connector is formed to connect with a shoulder strap. Further, a plurality of studs are affixed with and project from the shoulder strap connector.

In another aspect, the shoulder strap connector is formed of a flexible material and includes a pair of fastener portions (e.g., hook and loop fasteners, snaps, zipper, stitching, etc.) for allowing the should strap connector to wrap around and connect with the shoulder strap.

In another aspect, the plurality of studs are formed of varying sizes.

In yet another aspect, individual studs within the plurality of studs increase in at least one of width and height from a periphery to a center of the plurality of studs.

In another aspect, an adjuster is affixed with the shoulder strap connector.

In yet another aspect, the shoulder strap connector includes a length and the adjuster is an elongated strip with two opposing loops connected along the length of the shoulder strap connector.

In another aspect, the plurality of studs project from a stud portion. The stud portion formed of an inner core and an outer molding. The outer molding is formed of a material that is softer than the inner core. Further, each stud is formed of a rigid post (i.e., part of the inner core) positioned within an outer shell (i.e., part of the outer molding).

In yet another aspect, a space exists between the rigid post and the outer shell.

In another aspect, the invention is directed to a shoulder strap. The shoulder strap includes an elongated piece of material (e.g., fabric, rubber, neoprene, etc.) with a plurality of studs affixed with the elongated piece of material. The plurality of studs are concentrated together and affixed with the elongated piece of material such that when the shoulder strap is affixed with an item and placed over the shoulders of a user, the plurality of studs are forced against the user's muscles. Further, the plurality of studs are positioned such that when the shoulder strap is affixed with an item and placed over the shoulders of a user, the plurality of studs are forced against the user's trapezius muscles.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
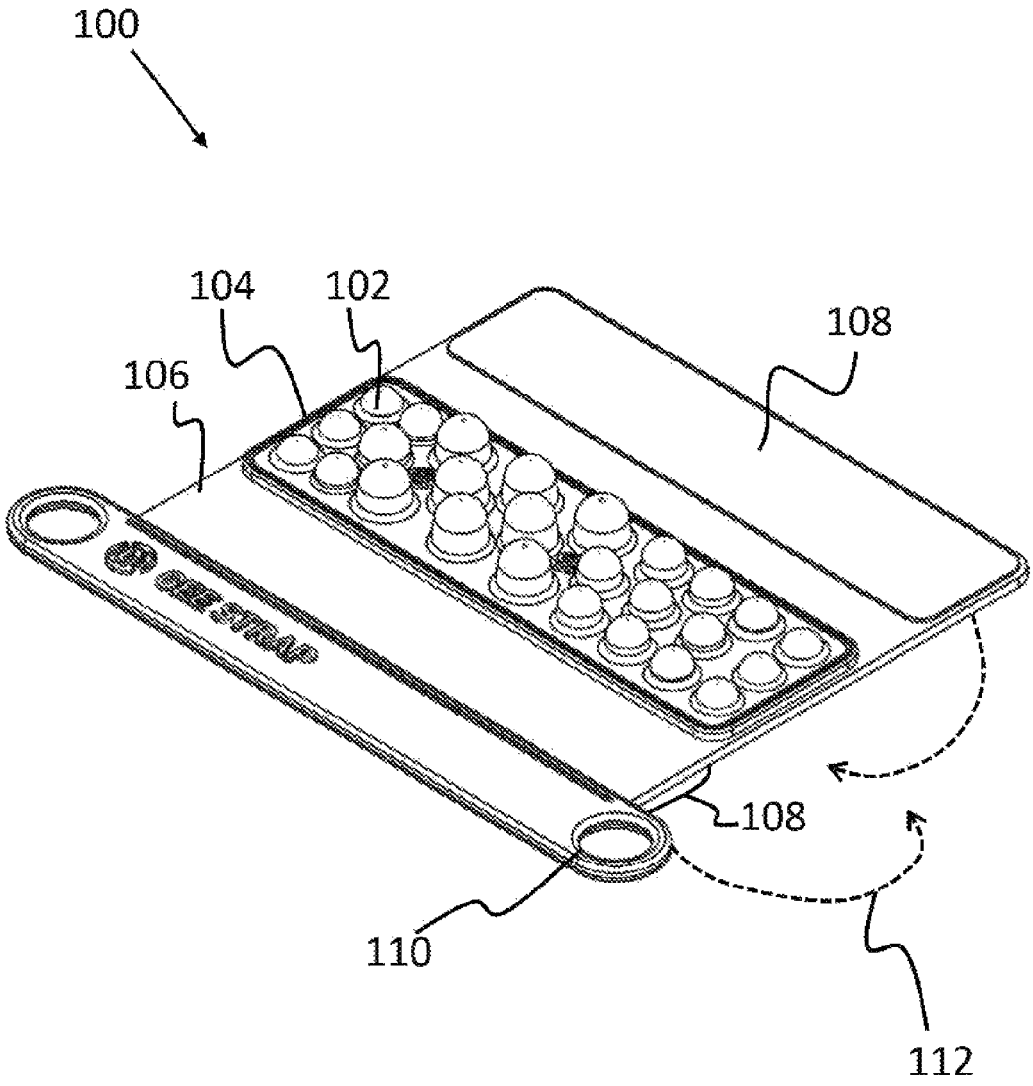
FIG. 1 is an elevated-view illustration of a strap pad according to various embodiments of the present invention, depicting a shoulder strap connector and stud portion.

The present invention relates to shoulder straps and, more particularly, to a strap pad for a shoulder strap having studs that are shaped and positioned to provide pressure to pressure points located within the muscle when the shoulder strap is positioned around the neck or shoulders of a user. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As noted above and as illustrated in FIG. 1, this disclosure is directed to a strap pad 100 having a plurality of studs 102 that are shaped and positioned to provide pressure to pressure points located within the muscle when the strap pad 100 is positioned around the neck or shoulders of a user, thereby massaging the muscle and reducing stresses caused by the weight of the item attached to the shoulder strap.

For example, the strap pad 100 can be attached with a shoulder strap for a variety items, non-limiting examples of which include a guitar, a golf bag, a purse, etc. Thus, when the shoulder strap and accompanying strap pad 100 are positioned around the user's neck or shoulders, the studs 102 apply targeted relieve to the trapezius muscles to relieve stress and disperse the weight of the item and, in doing so, reduce shoulder and neck pain from extend usage. The strap pad 100 is described in in further detail below.

The strap pad 100 includes a plurality of studs 102 that protrude from the strap pad 100. The studs 102 are formed of any suitable material and using any suitable technique to form such a feature that can provide muscle relief. As a non-limiting example, the studs 102 are formed as a plastic molded stud portion having a base 104 from which the studs 102 project. Thus, in this example, the molded stud portion features a series of hard studs 102 that apply pressure to the shoulder, targeting the trapezius muscle. The studs 102 can be uniform or, desirably, vary in size to disperse the pressure and weight of the items across the muscle more evenly, reducing the stress created.

In various embodiments, the stud portion is affixed with a shoulder strap connector 106. For example, the base 104 of the stud portion can be glued, sewn onto, or otherwise affixed with the shoulder strap connector 106. The shoulder strap connector 106 is formed to allow a user to easily affix the strap pad 100 with any shoulder strap. The shoulder strap connector 106 is, for example, a piece of fabric, neoprene, rubber, or any other suitable material that allows the strap pad 100 to easily wrap around or otherwise affix with any pre-existing shoulder strap. Further, the shoulder strap connector 106 can be attached with itself (e.g., if wrapped around the strap pad) or directly to the shoulder strap using any suitable technique to affix to components, a non-limiting example of which includes a pair of fastener portions 108 (e.g., hook and loop fasteners (Velcro™), snaps, zippers, etc.) that can be used to securely affix the strap pad 100 with a shoulder strap. Other non-limiting examples include snaps, buttons, zippers, glue, being sewn or stitched, etc. It should also be noted that in other various embodiments, the stud portion or studs themselves can serve as the shoulder strap connector 106. For example, in embodiments where the studs themselves are affixed directly to a shoulder strap, the studs would then serve as both massaging studs and a shoulder strap connector. Similarly, in embodiments where the stud portion is affixed directly to a shoulder strap, the stud portion would then serve as both a base for the studs and a shoulder strap connector.

In various embodiments the strap pad 100 is permanently affixed or part of the shoulder strap and/or the studs or stud portion are permanently affixed or part of the shoulder strap. However, in other embodiments, the strap pad 100 is adjustable. For example, once affixed with a shoulder strap, it may be desirable to adjust the actual placement location of the strap pad 100. Thus, the strap pad 100 also includes one or more adjusters 110 that allow the user to re-position the pad 100 once it has been placed over the shoulder, pulling it forward and back to their comfort. The adjuster 110 is any suitable mechanism or device that allows a user to easily grasp and reposition the strap pad 100. For example, the adjuster 110 is comprised of a molded flexible plastic strip with adjustment loops that is affixed to the shoulder strap connector 106. In this aspect, the adjustment loops allow a user to easily place a finger within one of the loops and slide the strap pad 100 along the shoulder strap to the desired location. It should be noted that although the adjuster 110 is described as being an elongated plastic strip with two opposing loops, the invention is not intended to be limited thereto as the adjuster 110 can simply be fabric loops sewn onto each end of the pad 100, or any other configuration that allows a user to grasp and slide the pad, including one, two, or any number of loops or holds. However, an advantage of having the adjuster 110 being formed as an elongated plastic strip that traverses (and is connected along) the length of the pad 100 with two opposing loops is that it disperses the pressure when pulled across the length of the strap pad 100 without stretching or deforming the strap pad 100.

Figure 2:
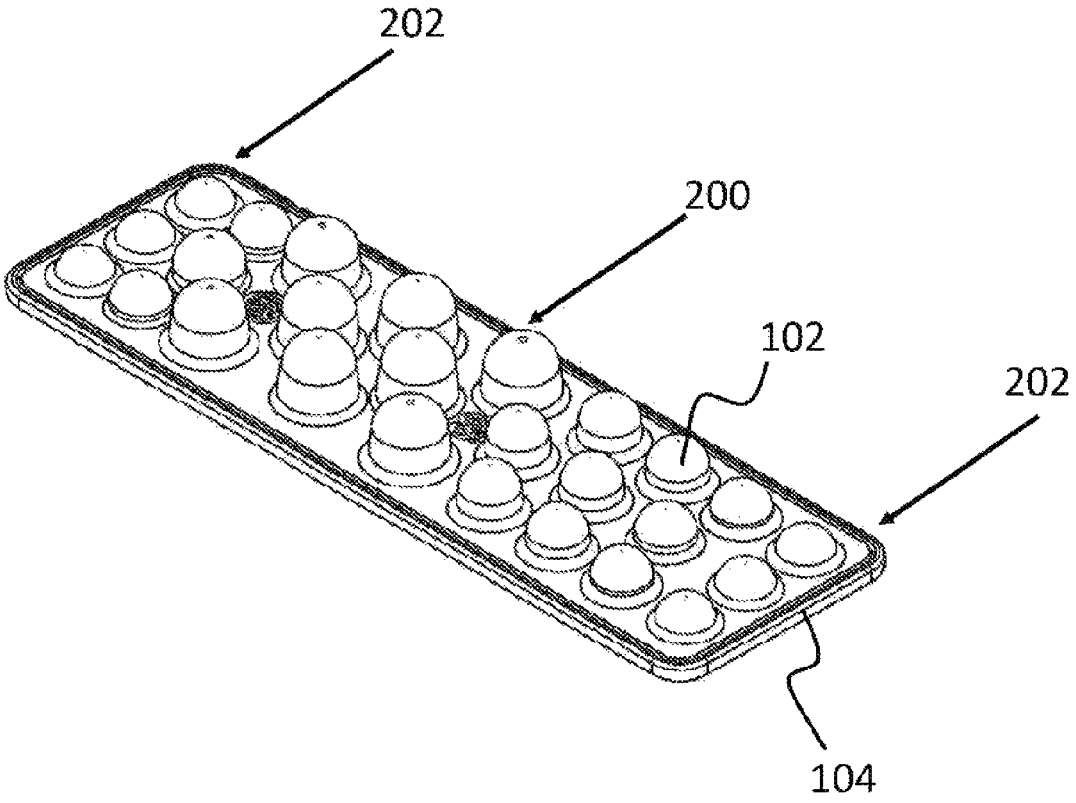
FIG. 2 is an elevated-view illustration of the stud portion according to various embodiments of the present invention.

FIG. 2 illustrates the stud portion, including its base 104 and plurality of projecting studs 102. It should be noted that although the studs 102 are described as being affixed with a strap pad for attaching to a separately formed shoulder strap, the invention is not intended to be limited thereto as the studs 100 can be directly incorporated into a shoulder strap (e.g., guitar strap) itself as opposed to being a separately formed and selectively attachable piece. In other words, this disclosure also includes any shoulder strap that includes a plurality of projecting studs 102 that are positioned and affixed to a shoulder strap at a location that positions the studs 102 adjacent to a user's trapezius muscles.

It should also be noted that although the stud portion is described as having a base 102 with a plurality of projecting studs 102, the stud portion can also be formed as having separately formed and attached studs 102. For example, in another aspect, the studs 102 can be separately formed and individually attached to the strap pad 100 or, in another aspect, the shoulder strap directly.

Figure 3:
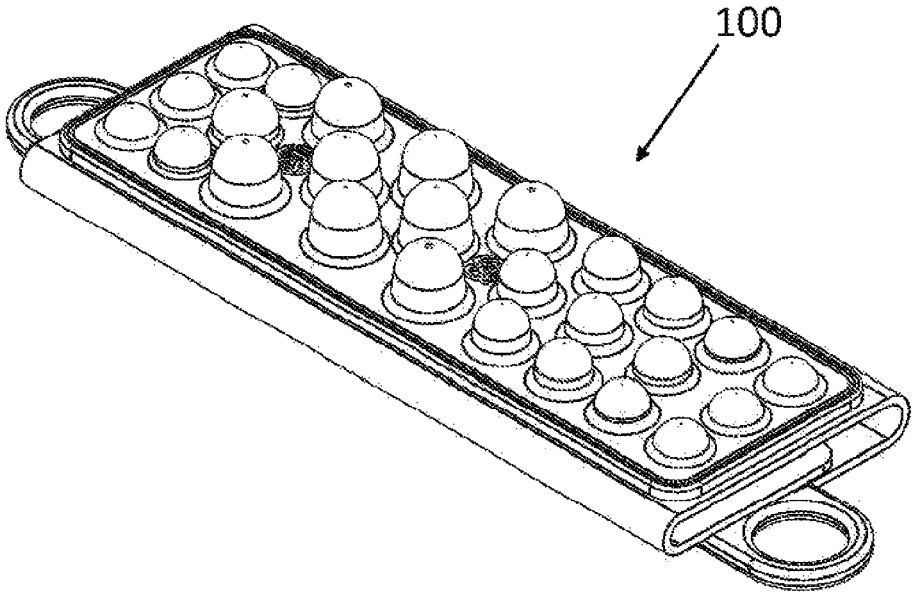
FIG. 3 is a front, elevated-view illustration of the strap pad, depicting the strap pad in a closed configuration for wrapping around and attaching with a shoulder strap.
Figure 4:
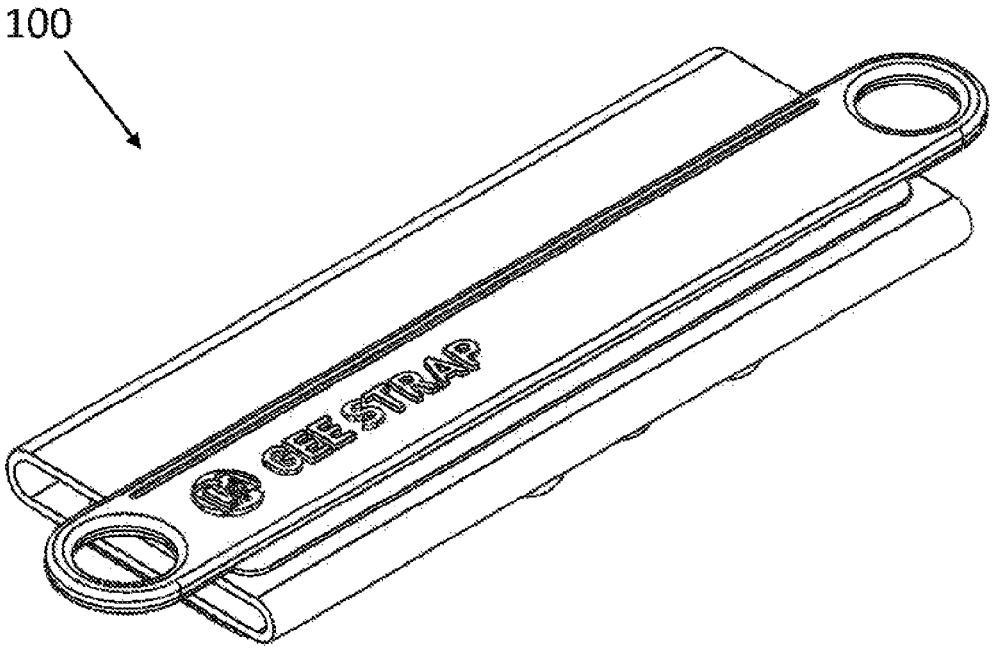
FIG. 4 is a rear, elevated-view illustration of the strap pad, depicting the strap pad in the closed configuration for wrapping around and attaching with a shoulder strap.

As noted above and in various embodiments, the strap pad 100 is formed to wrap around and affix with any pre-existing shoulder strap. FIG. 1, for example, depicts how the strap pad 100 folds 112 upon itself to adhere the pair of hook and loop fasteners 108 together. Once wrapped around and adhered together, the strap pad 100 is in a closed configuration, as shown in FIGS. 3 and 4. FIG. 3, for example, is a front-view illustration depicting the strap pad 100 in the closed configuration as if wrapped around and attached with a shoulder strap. Alternatively, FIG. 4 is a rear-view illustration depicting the strap pad 100 in the closed configuration.

Figure 5:
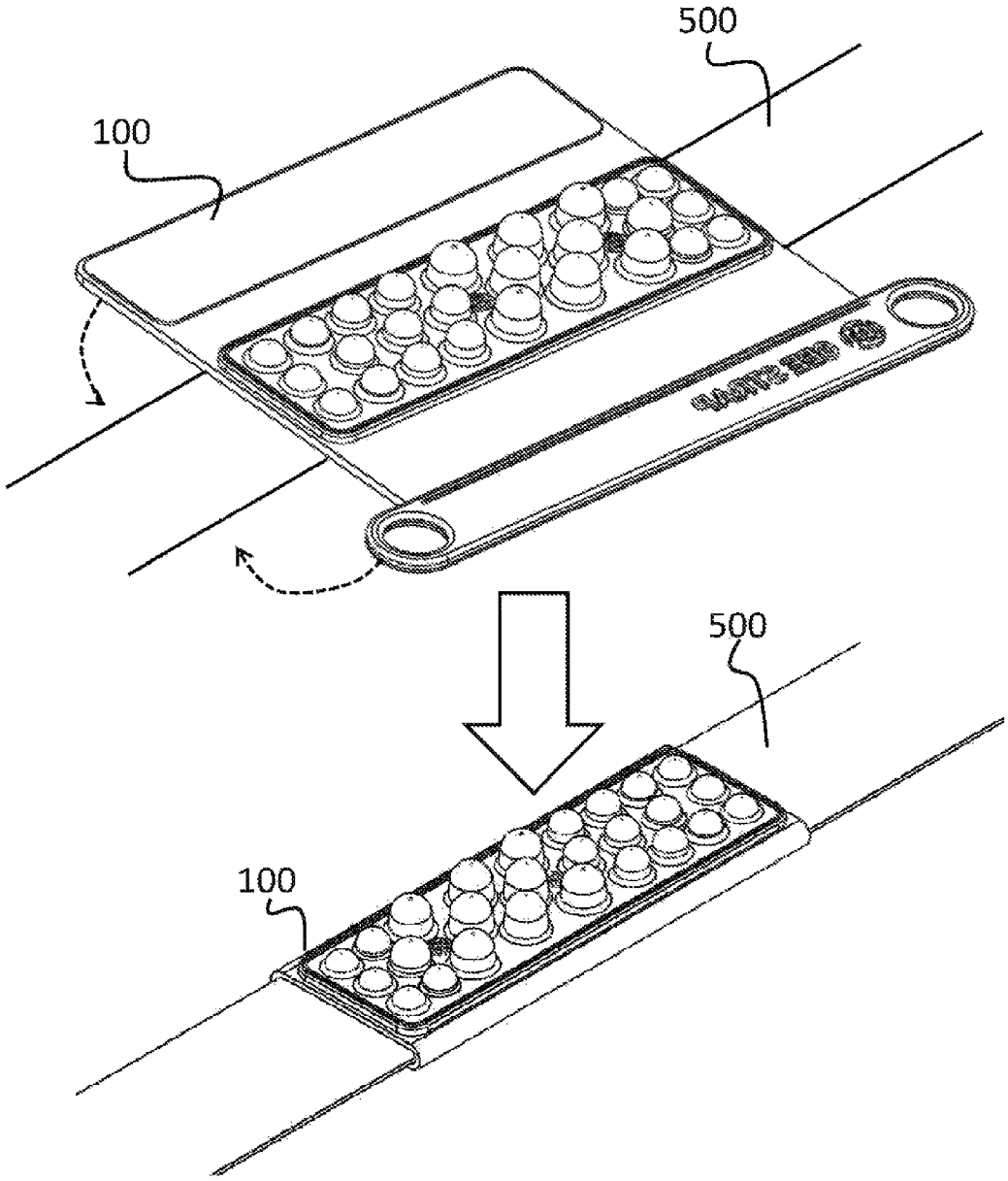
FIG. 5 is a front, elevated-view illustration of the strap pad, depicting the strap pad as being wrapped around and attached with a shoulder strap.
Figure 6:
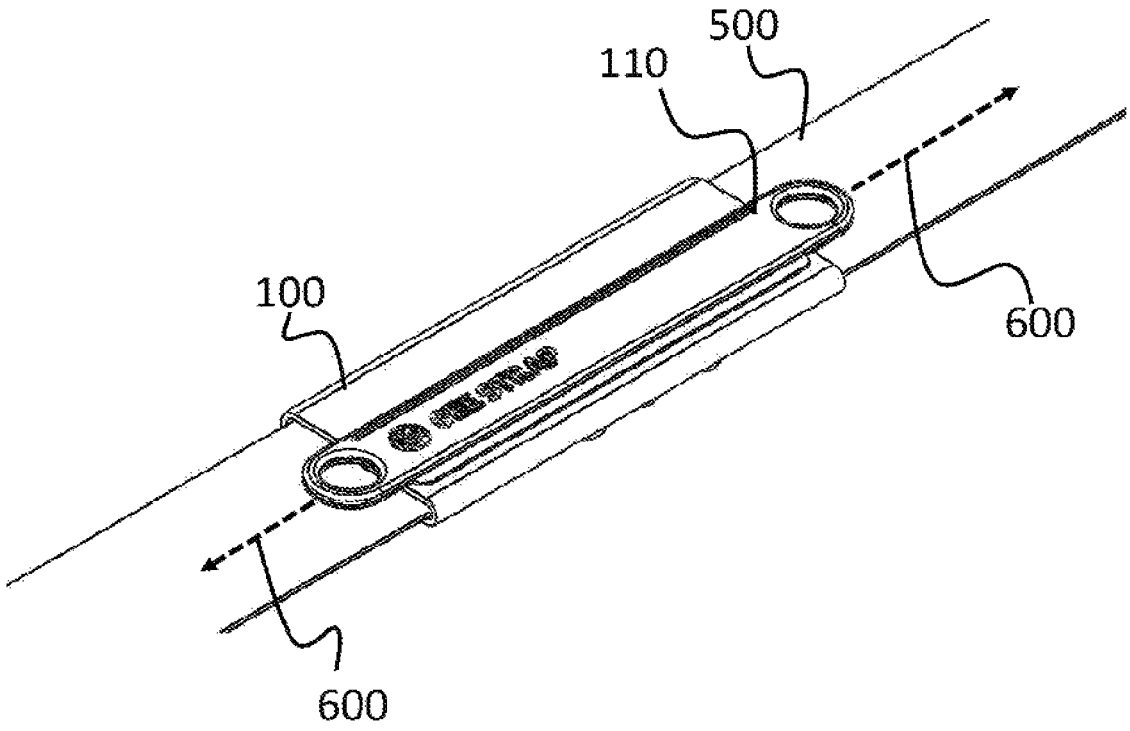
FIG. 6 is a rear, elevated-view illustration of the strap pad, depicting the strap pad as wrapped around and attached with the shoulder strap.

For further understanding. FIG. 5 is an illustration depicting the strap pad 100 being wrapped around and affixed with a shoulder strap 500. FIG. 6 depicts a rear-view of the strap pad 100 as wrapped around and attached with the shoulder strap 500. Notably, the adjuster 110 is shown with its corresponding adjustment loops to allow a user to easily place a finger within one of the loops and slide 600 the strap pad 100 along the shoulder strap 500 to the desired location.

Figure 7:
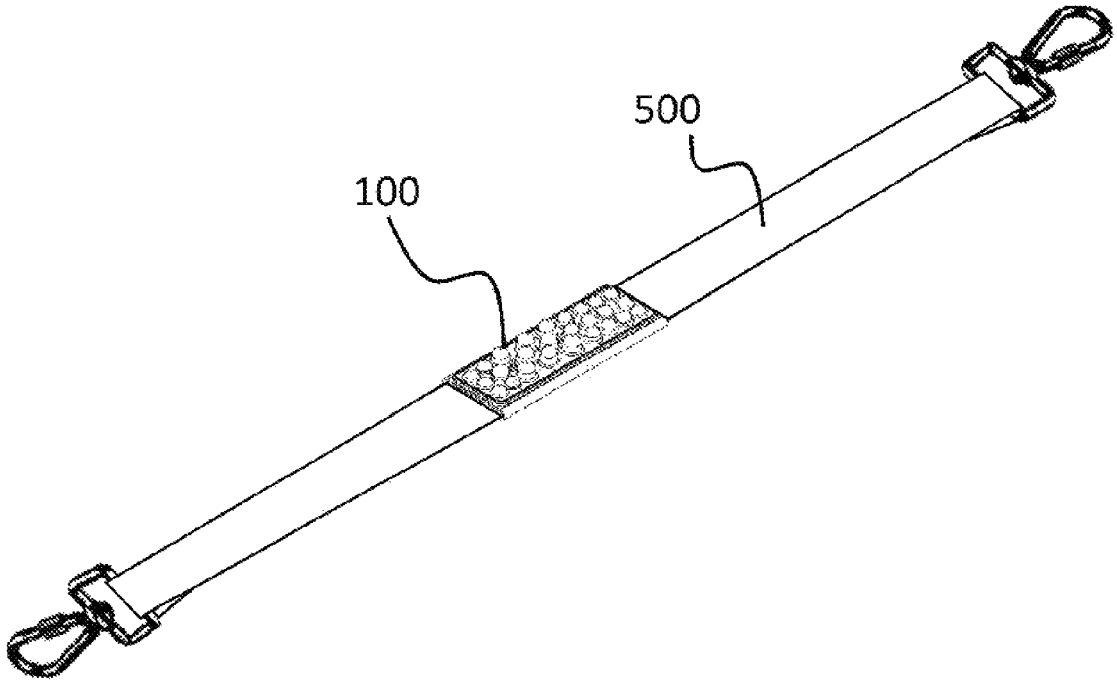
FIG. 7 is a front, elevated-view illustration of the strap pad, depicting the strap pad as wrapped around and attached with the shoulder strap.
Figure 8:
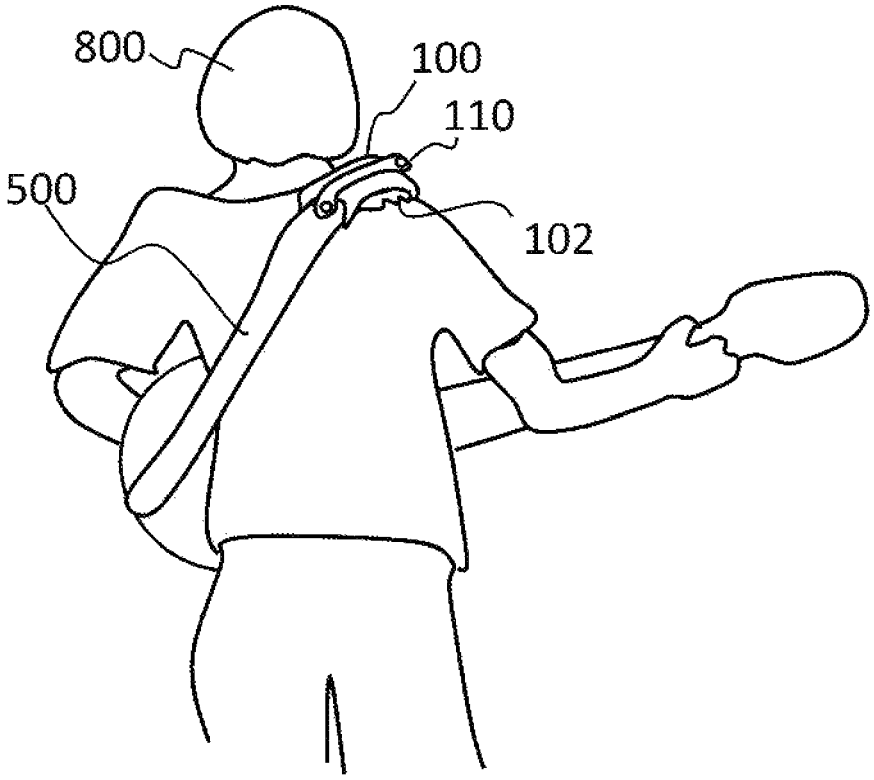
FIG. 8 is an illustration depicting the strap pad as attached with a guitar strap.
Figure 9:
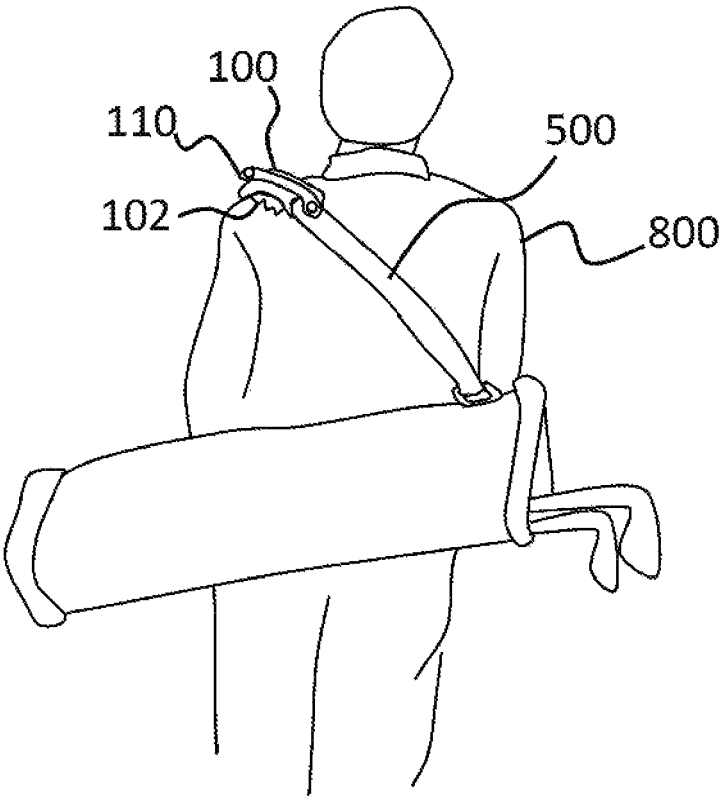
FIG. 9 is an illustration depicting the strap pad as attached with a golf bag strap.

As noted above and as shown in FIGS. 7, 8, and 9, the strap pad 100 can be attached with any shoulder strap 500 and/or incorporated into any item that is positioned around a user's shoulders or other body part. For example, FIG. 7 depicts the strap pad 100 as affixed with a generic or universal shoulder strap 500, while FIG. 8 depicts the strap pad 100 as affixed with the shoulder strap 500 of a guitar (i.e., guitar strap). Finally, FIG. 9 depicts the strap pad 100 as affixed with the shoulder strap 500 of golf bag. Notably, in the figures it is shown that the studs 102 are directed toward the trapezius muscles of the user 800 while the adjuster 110 is directed away for the user 800 for ease of use. Further, it should be noted that the strap pad 100 can be an add on item to any of these or other products or incorporated directly into the items.

As yet another non-limiting example, the strap pad 100 and/or studs 102 can be incorporated into and/or attached with a neck pad, similar to the neck pads sold in airports that wrap around a wearer's neck and support the head during a flight. In the example of the neck pad, the neck pad itself is the shoulder strap as it is positioned over the shoulders and around a user's neck. Thus, in this example, the component that holds or otherwise allows the studs to be attached with the neck pad serves as the shoulder strap connector. In its simplest component, this can be stitching, adhesive, etc., where in other aspects, this includes additional components that allow for the studs to be attached with the neck pad. For example, the studs 102 (with or without the various strap pad 100 portions or directly) can be stitched or otherwise adhered to the neck pad, which positions the studs 102 against the user's shoulders and/or neck. In another aspect, the strap pad 100 can be formed as a separate component that can be attached to a neck pad, such as a sleeve or by being attached via fasteners. As can be appreciated, this concept can be extended to a number of items, including backpack shoulder straps, etc.

Further and as illustrated in FIG. 2, the size of the studs 102 can all be the same or vary. When the sizes of the studs 102 vary, they can be positioned and vary across the strap pad 100 in any configuration. As a non-limiting example, the studs 102 increase in size tow and a center 200 of the stud portion. Thus, studs 102 toward the center 200 of the stud portion are larger than the studs 102 at a periphery 202 of the stud portion. This is further illustrated in FIGS. 10A through 10C. An advantage to such a configuration is that the larger studs 102 at the center 200 of the stud portion will be used to apply more pressure to the targeted muscle (e.g., trapezius or any other muscle over which the studs 102 are positioned). In other words, the strap pad 100 includes the series of rigid studs 102 that apply targeted pressure to the shoulder using the weight of an attached item (e.g., guitar, golf bag, etc.). In use, a user can easily rock the strap pad 100 back and forth to massage out the shoulder knots and muscle tension.

It should also be noted that the studs 102 are of a sufficient length and firmness to engage with and massage muscle pressure points based on being positioned appropriately and the weight of the attached item. As a non-limiting example, the studs 102 are formed to massage muscle pressure points on the shoulder and upper back (e.g., trapezius muscles) by the weight of the item attached to the shoulder strap, such as guitars, etc. The weight of the item attached to the shoulder strap or strap attachment is the source of the pressure combined with the manipulation of the item or object.

As understood by those skilled in the art, tension tends to concentrate around acupressure points. When a muscle is chronically tense or in spasm, the muscle fibers contract due to the secretion of lactic acid caused by fatigue, trauma, stress, chemical imbalances, or poor circulation. For instance, when someone is under a great deal of stress that person may have difficulty breathing. Certain acupressure points relieve chest tension and enable one to breathe deeply.

As a pressure point is pressed, the muscle tension yields to the stud pressure, enabling the muscle fibers to elongate and relax, blood to flow freely, and toxins to be released and eliminated. Increased circulation also brings more oxygen and other nutrients to affected areas. This increases the body's resistance to illness and promotes a longer, healthier, more vital life. When the blood and bioelectrical energy circulate properly, one has a greater sense of harmony, health, and well-being. Thus, the invention as described herein includes studs that are designed to massage the muscle pressure points and provide the added benefits, as described above.

Figure 10A:
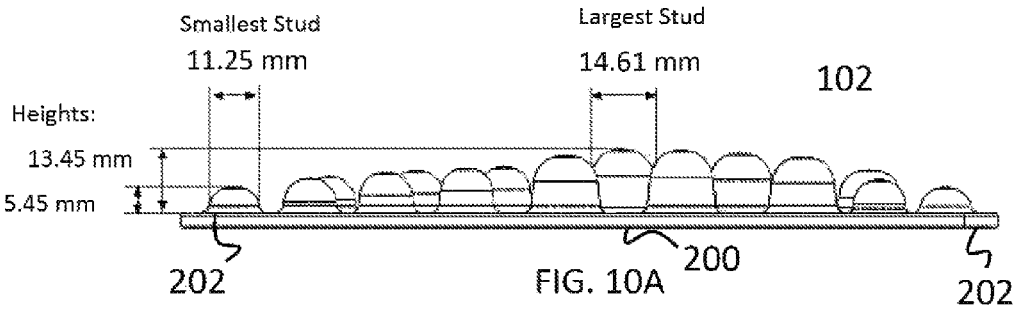
FIG. 10A is a side-view illustration of the stud portion according to various embodiments of the present invention.
Figure 10B:
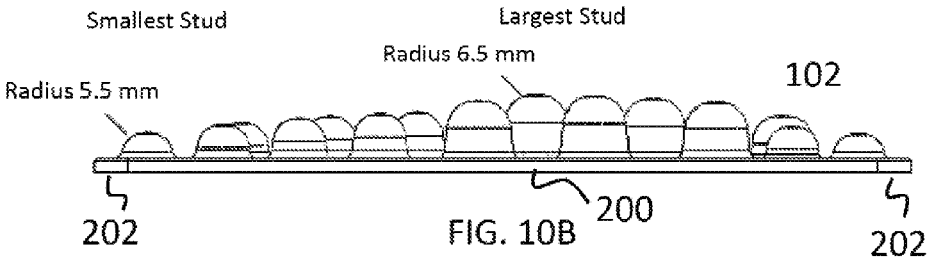
FIG. 10B is a side-view illustration of the stud portion according to various embodiments of the present invention.
Figure 10C:
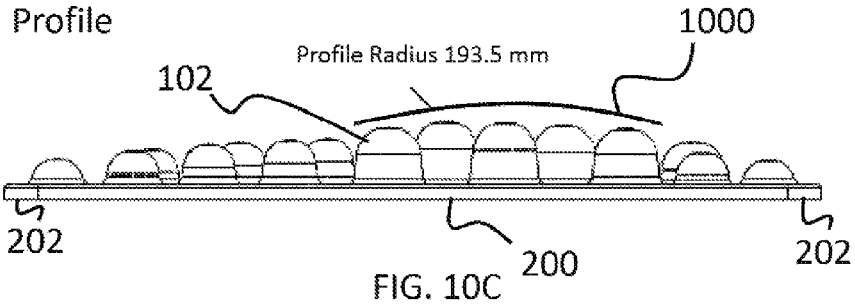
FIG. 10C is a side-view illustration of the stud portion according to various embodiments of the present invention.

For further understanding, FIGS. 10A through 10C illustrate non-limiting examples of stud 102 sizing and shaping that is sufficient to provide the therapeutic massaging effects of die device described herein. FIGS. 10A and 10B are side-view illustrations of the stud portion, depicting non-limiting examples of stud 102 sizes and how they vary across the stud portion. It should be noted that the stud 102 sizes, radii, and positioning depicted in the figures are provided as desired dimensions, but the invention is not intended to be limited thereto as the depicted features, sizes, radii and positioning can be varied in accordance with the present invention. As a non-limiting example, the widths can be in a range of 1 millimeter to 30 millimeters, and desirably, between 3 millimeters and 20 millimeters and, more desirably, between 8 millimeters and 18 millimeters, or any other desired width so long as, it provides a massaging effect when applied with weight to the user's muscles. Further and as a non-limiting example, the heights can be in a range of 2 millimeter to 30 millimeters, and desirably, between 3 millimeters and 20 millimeters and, more desirably, between 4 millimeters and 16 millimeters, or any other desired height so long as it provides a massaging effect when applied with weight to the user's muscles. Further and as a non-limiting example, the radii of the studs 102 can be in a range of 2 millimeter to 12 millimeters, and desirably, between 3 millimeters and 10 millimeters and, more desirably, between 4 millimeters and 8 millimeters, or any other desired radii so long as it provides a massaging effect when applied with weight to the user's muscles.

FIG. 10C is a side-view illustration of the stud portion, depicting a raised island 1000 of studs 102 that allows the strap pad 100 to target the pressure point. Without it, the pressure is dissipated evenly, which is similar to strap pads of the prior art. Thus, in one aspect of the present invention, a plurality of studs 102 centrally disposed on the stud portion increase in either width or height (or desirably both width and height) from the periphery 202 of the stud portion toward the center 200 of the stud portion. This assists in targeting the massaging effects of the studs 102 at the desired section of the user's muscles. It should be noted that the depicted profile radius of the raised island 1000 of studs is provided as a non-limiting example of a desired profile radius and that the invention is not intended to be limited thereto and can be formed within any desired range, a non-limiting example of which includes a profile radius between 150 and 250 millimeters, or any other desired profile radius so long as it provides a massaging effect when applied with weight to the user's muscles.

Figure 11:
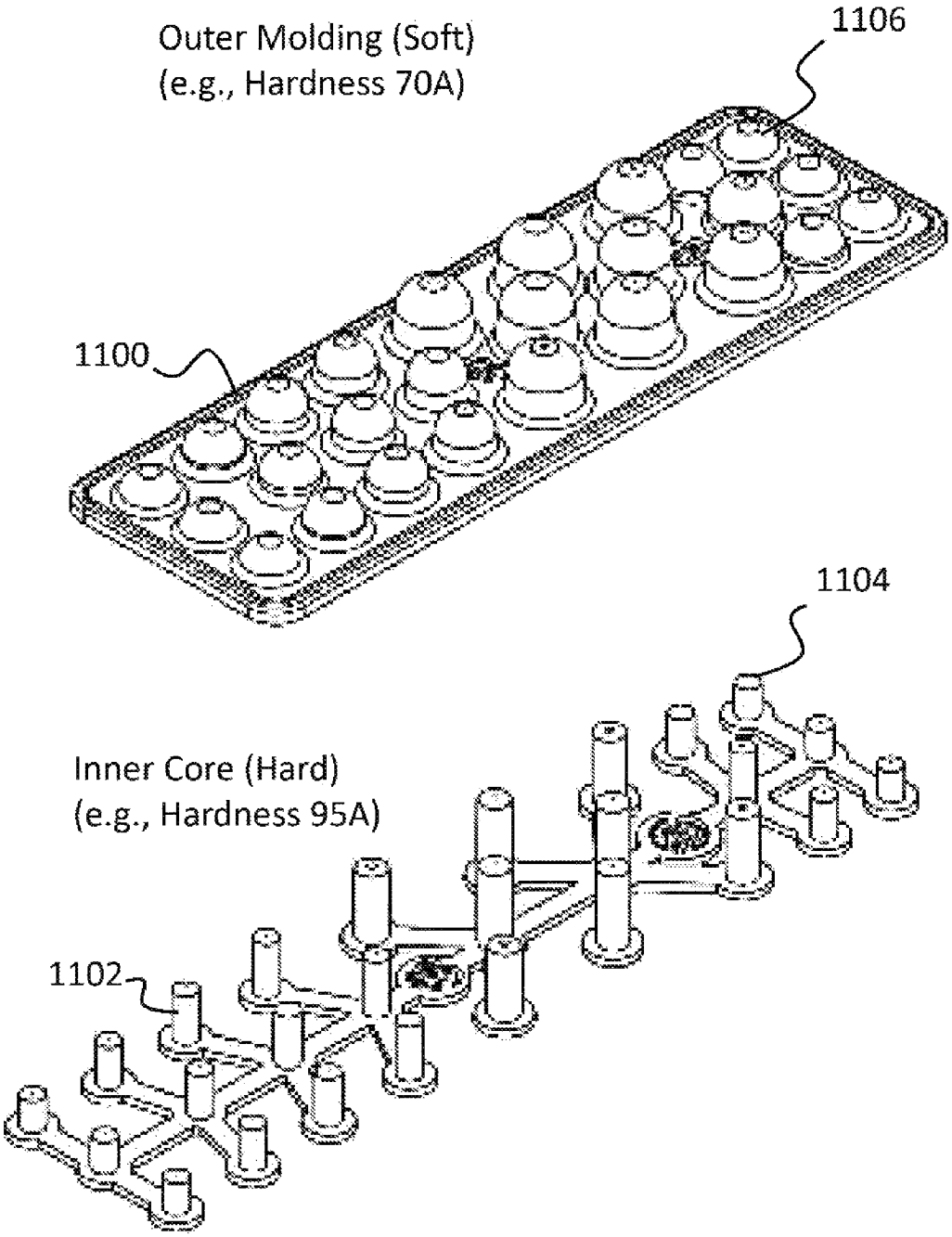
FIG. 11 is an illustration of the stud portion according to various embodiments, depicting an example hard inner core and soft outer molding.

It should be noted that the studs 102 can be formed of any desired hardness and in any suitable manner, so long as they provide enough rigidity to provide a massaging effect. The studs 102 can be formed as a single piece or multiple pieces. As a non-limiting example and as depicted in FIG. 11, the stud portion can be formed of a soft outer molding 1100 and a hard inner core 1102. The use of the words soft and hard are used in relation to one another, such that the outer molding 1100 is softer on the hardness scale than the inner core 1102. For example, the soft outer molding 1100 is formed of a pliable rubber with a hardness on the shore scale between 40 A and 120 A, or desirably between 50 A and 90 A, and more desirably, between 65 A and 75 A, or of any other material and/or hardness.

Further, the hard inner core 1102 is formed of a rigid rubber with a hardness on the shore scale between 70 A and 120 A, or desirably between 80 A and 110 A, and more desirably, between 90 and 100 A, or of any other material and/or hardness. In the non-limiting example in which there exists a hard inner core 1102 and a soft outer molding 1100, each stud formed of a hard rigid post 1104 that is positioned within a softer outer shell 1106. The rigid post 1104 provides a rigid and stable skeleton or support to provide the massaging effect, while the softer outer shell 1106 provides a flexible and comfortable surface to the user. In another aspect, the diameter or width of the rigid post 1104 is less than the inner width of the corresponding outer shell 1106 such when the rigid post 1104 is positioned within the outer shell 1106, there is sufficient space (e.g., 1 millimeter, or any other desired spacing) between the rigid post 1104 and outer shell 1106 to allow the outer shell 1106 to compress slightly. The compression of the outer shell 1106 before impacting the rigid post 1104 serves to increase comfort to the user when using the device.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use die recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A strap pad, comprising:

a shoulder strap connector, the shoulder strap connector formed to connect with a shoulder strap; and a plurality of studs affixed with and projecting from the shoulder strap connector;

wherein at least a portion of the plurality of studs have a hardness on a shore scale between 40 A and 120 A;

wherein the plurality of studs each have a width between three millimeters and twenty millimeters;

wherein the plurality of studs each have a height between three millimeters and twenty millimeters; and wherein at least some individual studs within the plurality of studs increase in height from a periphery toward a center of the plurality of studs.

2. The strap pad as set forth in claim 1, wherein the shoulder strap connector is formed of a flexible material and includes a pair of fastener portions for allowing the should strap connector to wrap around and connect with the shoulder strap.

3. The strap pad as set forth in claim 2, wherein the plurality of studs are formed of varying sizes.

4. The strap pad as set forth in claim 3, wherein individual studs within the plurality of studs increase in both width and height from a periphery to a center of the plurality of studs.

5. The strap pad as set forth in claim 4, further comprising an adjuster affixed with the shoulder strap connector.

6. The strap pad as set forth in claim 5, wherein the shoulder strap connector includes a length and the adjuster is an elongated strip with two opposing loops that traverses and is connected along an entire length of the shoulder strap connector such that the two opposing loops extend beyond the length of the shoulder strap connector, whereby when used, the adjuster disperses pressure when pulled across the length of the strap pad without stretching or deforming the strap pad.

7. The strap pad as set forth in claim 6, wherein the plurality of studs project from a stud portion, the stud portion formed of an inner core and an outer molding covering at least a portion of the inner core, the outer molding being formed of a material having a hardness on the shore scale between 40 A and 120 A and the inner core being formed of a material having a hardness on the shore scale between 70 A and 120 A.

8. The strap pad as set forth in claim 7, wherein each stud is formed of a rigid post formed in the inner core that is positioned within an outer shell formed in the outer molding.

9. The strap pad as set forth in claim 1, wherein the plurality of studs are formed of varying sizes such that the studs increasing in height from the periphery toward the center of the plurality of studs have a profile radius between 150 and 250 millimeters.

10. The strap pad as set forth in claim 1, wherein individual studs within the plurality of studs increase in both width and height from a periphery to a center of the plurality of studs.

11. The strap pad as set forth in claim 1, further comprising an adjuster affixed with the shoulder strap connector.

12. The strap pad as set forth in claim 11, wherein the shoulder strap connector includes a length and the adjuster is an elongated strip with two opposing loops that traverses and is connected along an entire length of the shoulder strap connector such that the two opposing loops extend beyond the length of the shoulder strap connector, whereby when used, the adjuster disperses pressure when pulled across the length of the strap pad without stretching or deforming the strap pad.

13. The strap pad as set forth in claim 1, wherein the plurality of studs project from a stud portion, the stud portion formed of an inner core and an outer molding covering at least a portion of the inner core, the outer molding being formed of a material having a hardness on the shore scale between 40 A and 120 A and the inner core being formed of a material having a hardness on the shore scale between 70 A and 120 A.

14. The strap pad as set forth in claim 1, wherein each stud is formed of a rigid post formed in the inner core that is positioned within an outer shell formed in the outer molding.

15. The strap pad as set forth in claim 1, wherein each of the studs within the plurality of studs has a curved top portion having a radius.

16. The strap pad as set forth in claim 15, wherein the radius of the curved top portion is between two millimeters and twelve millimeters.

17. A shoulder strap, comprising:

an elongated piece of material; and a plurality of studs affixed with the elongated piece of material, the plurality of studs having a hardness on a shore scale between 40 A and 120 A and being concentrated together and affixed with the elongated piece of material such that at least some individual studs within the plurality of studs increase in height from a periphery toward a center of the plurality of studs, such that when the shoulder strap is affixed with an item and placed over the shoulders of a user, the plurality of studs are forced against the user's muscles.

18. The shoulder strap as set forth in claim 17, wherein the plurality of studs increase in height from a periphery toward a center of the plurality of studs to have a profile radius between 150 and 250 millimeters, and wherein the plurality of studs are positioned such that when the shoulder strap is affixed with an item and placed over the shoulders of a user, the plurality of studs are forced against the user's trapezius muscles.

* * * * *